US010053652B2

(12) United States Patent
Blattner et al.

(10) Patent No.: US 10,053,652 B2
(45) **Date of Patent: *Aug. 21, 2018**

(54) BIO-BASED POT AND PAN PRE-SOAK

(71) Applicant: ECOLAB USA INC., Saint Paul, MN (US)

(72) Inventors: Amanda Ruth Blattner, Prior Lake, MN (US); Charles Allen Hodge, Cottage Grove, MN (US); Carter M. Silvernail, Burnsville, MN (US)

(73) Assignee: ECOLAB USA INC., Saint Paul, MN (US)

( * ) Notice: Subject to any disclaimer, the term of this patent is extended or adjusted under 35 U.S.C. 154(b) by 38 days.

This patent is subject to a terminal disclaimer.

(21) Appl. No.: 15/149,435

(22) Filed: May 9, 2016

(65) Prior Publication Data

US 2016/0251599 A1 Sep. 1, 2016

Related U.S. Application Data

(63) Continuation of application No. 14/278,773, filed on May 15, 2014, now Pat. No. 9,365,805.

(51) Int. Cl.

| | |
|---|---|
| ***C11D 3/37*** | (2006.01) |
| ***C11D 3/22*** | (2006.01) |
| ***C11D 3/00*** | (2006.01) |
| ***C11D 3/04*** | (2006.01) |
| ***C11D 3/08*** | (2006.01) |
| ***C11D 3/10*** | (2006.01) |
| ***C11D 17/00*** | (2006.01) |
| ***C11D 1/66*** | (2006.01) |
| ***C11D 3/12*** | (2006.01) |
| ***C11D 3/20*** | (2006.01) |

(52) U.S. Cl.

CPC ..... *C11D 3/222* (2013.01); *C11D 1/66* (2013.01); *C11D 3/0073* (2013.01); *C11D 3/044* (2013.01); *C11D 3/08* (2013.01); *C11D 3/10* (2013.01); *C11D 3/1246* (2013.01); *C11D 3/2075* (2013.01); *C11D 3/2086* (2013.01); *C11D 3/37* (2013.01); *C11D 17/0047* (2013.01); *C11D 17/0052* (2013.01)

(58) Field of Classification Search

CPC ..... C11D 3/222; C11D 3/0073; C11D 3/044
USPC ..... 510/218
See application file for complete search history.

(56) References Cited

U.S. PATENT DOCUMENTS

| | | | |
|---|---|---|---|
| 2,536,658 | A | 2/1951 | Rheineck |
| 2,798,053 | A | 7/1957 | Brown |
| 2,954,347 | A | 9/1960 | St. John et al. |
| 3,048,548 | A | 8/1962 | Martin et al. |
| 3,308,067 | A | 3/1967 | Diehl |
| 3,314,891 | A | 4/1967 | Schmolka et al. |
| 3,334,147 | A | 8/1967 | Brunelle |
| 3,442,242 | A | 5/1969 | Laskey et al. |
| 3,455,839 | A | 7/1969 | Rauner |
| 3,518,176 | A | 6/1970 | Reyes et al. |
| 3,629,121 | A | 12/1971 | Eldib et al. |
| 3,639,312 | A | 2/1972 | Turner et al. |
| 3,673,148 | A | 6/1972 | Vasta |
| 3,687,878 | A | 8/1972 | Imoto et al. |
| 3,723,322 | A | 3/1973 | Diehl |
| 3,803,285 | A | 4/1974 | Jensen |
| 3,929,107 | A | 12/1975 | Renger |
| 3,929,678 | A | 12/1975 | Laughlin et al. |
| 3,933,672 | A | 1/1976 | Bartolotta et al. |
| 4,048,122 | A | 9/1977 | Sibley et al. |
| 4,133,779 | A | 1/1979 | Hellyer et al. |
| 4,141,841 | A | 2/1979 | McDanald |
| 4,228,042 | A | 10/1980 | Letton |
| 4,239,660 | A | 12/1980 | Kingry |
| 4,260,529 | A | 4/1981 | Letton |
| 4,265,779 | A | 5/1981 | Gandolfo et al. |
| 4,322,472 | A | 3/1982 | Kaspar et al. |
| 4,374,035 | A | 2/1983 | Bossu |
| 4,379,080 | A | 4/1983 | Murphy |
| 4,388,205 | A | 6/1983 | Stettler et al. |
| 4,412,934 | A | 11/1983 | Chung et al. |

(Continued)

FOREIGN PATENT DOCUMENTS

| | | |
|---|---|---|
| CA | 2074747 | 2/1993 |
| DE | 4038908 | 6/1992 |

(Continued)

OTHER PUBLICATIONS

Dubois, Michel, et al., "Calorimetric Method for Determination of Sugars and Related Substances", Analytical Chemistry, vol. 28, No. 3, pp. 350-356. Mar. 3, 1956.

(Continued)

*Primary Examiner* — Gregory Webb
(74) *Attorney, Agent, or Firm* — McKee, Voorhees & Sease, PLC

(57) ABSTRACT

The present invention is a dimensionally stable solid detergent composition which can be used as a soaking composition. The composition includes a bio-based content of 58% or greater and includes an alkalinity source, a metal protector, a surfactant system, water, a threshold agent, and a polysaccharide hybrid polymer composition. The polymer the polysaccharide hybrid polymer composition includes a polysaccharide residue present in an amount from approximately 5% to 90% by weight of the polysaccharide hybrid polymer composition and a residue of at least one ethylenically unsaturated monomer or salts thereof present in an amount from approximately 10% to 75% by weight of the polysaccharide hybrid polymer composition.

18 Claims, No Drawings

(56) References Cited

U.S. PATENT DOCUMENTS 4,483,779 A 11/1984 Lienado et al.
4,483,780 A 11/1984 Lienado
4,521,578 A 6/1985 Chen et al.
4,536,314 A 8/1985 Hardy et al.
4,539,130 A 9/1985 Thompson et al.
4,557,763 A 12/1985 George et al.
4,565,647 A 1/1986 Lienado
4,597,898 A 7/1986 Vander Meer
4,605,721 A 8/1986 Jenkins et al.
4,606,838 A 8/1986 Burns
4,618,914 A 10/1986 Sato et al.
4,634,551 A 1/1987 Burns et al.
4,652,392 A 3/1987 Baginski et al.
4,671,891 A 6/1987 Hartman
4,681,592 A 7/1987 Hardy et al.
4,681,695 A 7/1987 Divo
4,681,704 A 7/1987 Bernardino et al.
4,686,063 A 8/1987 Burns
4,702,857 A 10/1987 Gosselink
4,782,901 A 11/1988 Phelps et al.
4,830,773 A 5/1989 Olson
4,855,069 A 8/1989 Schuppiser et al.
4,963,629 A 10/1990 Driemel et al.
4,968,451 A 11/1990 Scheibel et al.
5,032,659 A 7/1991 Heidel
5,071,895 A 12/1991 Hughes et al.
5,076,968 A 12/1991 Fringeli et al.
5,121,795 A 6/1992 Ewert et al.
5,125,455 A 6/1992 Harris et al.
5,127,795 A 7/1992 Piemmons et al.
5,223,171 A 6/1993 Jost et al.
5,227,446 A 7/1993 Denzinger et al.
5,248,449 A 9/1993 Mitchell et al.
5,264,470 A 11/1993 Eoff
5,304,620 A 4/1994 Holtmyer et al.
5,326,864 A 7/1994 Besemer et al.
5,332,528 A 7/1994 Pan et al.
5,378,830 A 1/1995 Yeh
5,385,959 A 1/1995 Tsaur et al.
5,415,807 A 5/1995 Gosselink et al.
5,435,935 A 7/1995 Kupneski
5,478,503 A 12/1995 Swift
5,500,154 A 3/1996 Bacon et al.
5,501,815 A 3/1996 Man
5,518,646 A 5/1996 Van den Brom
5,518,657 A 5/1996 Fringeli et al.
5,523,023 A 6/1996 Kleinstuck et al.
5,543,459 A 8/1996 Hartmann et al.
5,547,612 A 8/1996 Austin et al.
5,565,145 A 10/1996 Watson et al.
5,580,154 A 12/1996 Coulter et al.
5,580,941 A 12/1996 Krause et al.
5,583,193 A 12/1996 Aravindakshan et al.
5,654,198 A 8/1997 Carrier et al.
5,656,646 A 8/1997 Perner et al.
5,658,651 A 9/1997 Smith et al.
5,670,475 A 9/1997 Trinh et al.
5,674,511 A 10/1997 Kacher et al.
5,753,770 A 5/1998 Breitenbach et al.
5,756,442 A 5/1998 Jeschke et al.
5,760,154 A 6/1998 Krause et al.
5,830,241 A 11/1998 Rohringer et al.
5,852,069 A 12/1998 Meister et al.
5,854,191 A 12/1998 Krause et al.
5,854,321 A 12/1998 Krause et al.
5,869,070 A 2/1999 Dixon et al.
5,942,477 A 8/1999 Giret et al.
5,942,479 A 8/1999 Frankenbach et al.
5,942,485 A 8/1999 Kemen
5,945,127 A 8/1999 Breitenbach et al.
5,952,278 A 9/1999 Mao et al.
5,977,275 A 11/1999 Rodrigues et al.
5,985,809 A 11/1999 Frankenbach et al.
5,990,065 A 11/1999 Vinson et al.
6,004,922 A 12/1999 Watson et al.
6,008,181 A 12/1999 Cripe et al.
6,020,303 A 2/2000 Cripe et al.
6,022,844 A 2/2000 Baillely et al.
6,025,311 A 2/2000 Clarke et al.
6,060,299 A 5/2000 Sreekrishna et al.
6,060,443 A 5/2000 Cripe et al.
6,060,582 A 5/2000 Hubbell et al.
6,069,122 A 5/2000 Vinson et al.
6,093,856 A 7/2000 Cripe et al.
6,103,839 A 8/2000 Patel et al.
6,106,849 A 8/2000 Malkan et al.
6,130,194 A 10/2000 Pancheri et al.
6,136,769 A 10/2000 Asano et al.
6,143,707 A 11/2000 Trinh et al.
6,150,322 A 11/2000 Singleton et al.
6,153,570 A 11/2000 Decoster
6,153,577 A 11/2000 Cripe et al.
6,162,423 A 12/2000 Sebag et al.
6,169,062 B1 1/2001 Salager et al.
6,221,825 B1 4/2001 Williams, Jr. et al.
6,225,462 B1 5/2001 Berry et al.
6,227,446 B1 5/2001 Haney et al.
6,231,650 B1 5/2001 Mallow et al.
6,258,765 B1 7/2001 Wei et al.
6,303,560 B1 10/2001 Hartan et al.
6,365,561 B1 4/2002 Vinson et al.
6,372,708 B1 4/2002 Kasturi et al.
6,376,438 B1 4/2002 Rosenberger et al.
6,384,132 B1 5/2002 Horley et al.
6,451,747 B1 9/2002 Decoster
6,482,994 B2 11/2002 Scheper et al.
6,528,477 B2 3/2003 Kasturi et al.
6,537,957 B1 3/2003 Cardola et al.
6,573,234 B1 6/2003 Sivik et al.
6,589,926 B1 7/2003 Vinson et al.
6,605,182 B1 8/2003 Danner
6,627,590 B1 9/2003 Sherry et al.
6,645,925 B2 11/2003 Sivik et al.
6,653,266 B2 11/2003 Wei et al.
6,656,900 B2 12/2003 Sivik et al.
6,764,992 B2 7/2004 Kumar et al.
6,800,712 B2 10/2004 Doane et al.
6,867,262 B1 3/2005 Angel et al.
6,908,955 B2 6/2005 Prsch et al.
6,911,053 B1 6/2005 Bijsterbosch et al.
7,012,048 B2 3/2006 Drovetskaya et al.
7,087,662 B2 8/2006 Ghosh et al.
7,151,079 B2 12/2006 Fack et al.
7,153,821 B2 12/2006 Blokzijl et al.
7,157,413 B2 1/2007 Lazzeri et al.
7,589,051 B2 9/2009 Erazo-Majewicz et al.
7,666,963 B2 2/2010 Rodrigues et al.
7,670,388 B2 3/2010 Sugano et al.
7,727,945 B2 6/2010 Rodrigues et al.
7,740,873 B2 6/2010 Decoster et al.
7,754,666 B2 7/2010 Walters et al.
8,227,381 B2 7/2012 Rodrigues et al.
8,636,918 B2 1/2014 Silvernail et al.
2002/0016282 A1 2/2002 Kumar et al.
2002/0034487 A1 3/2002 Maubru et al.
2002/0055446 A1 5/2002 Perron et al.
2002/0106747 A1 8/2002 Cheng et al.
2002/0173592 A1 11/2002 Saeki et al.
2003/0008793 A1 1/2003 Takiguchi et al.
2003/0147827 A1 8/2003 Decoster et al.
2003/0147842 A1 8/2003 Restle et al.
2003/0211952 A1 11/2003 Erazo-Majewicz et al.
2004/0033929 A1 2/2004 Bertleff et al.
2004/0039137 A1 2/2004 Heinemann et al.
2004/0048760 A1 3/2004 Rabon et al.
2004/0067864 A1 4/2004 Aubay et al.
2004/0067865 A1 4/2004 Harrison
2004/0071742 A1 4/2004 Popplewell et al.
2004/0092425 A1 5/2004 Boutique et al.
2004/0102354 A1 5/2004 Fack et al.
2004/0103483 A1 6/2004 Delplancke et al.
2004/0107505 A1 6/2004 Harrison et al.
2004/0147425 A1 7/2004 Castro et al.
2004/0214736 A1 10/2004 Modi

(56) References Cited

U.S. PATENT DOCUMENTS

| | | | |
|---|---|---|---|
| 2004/0266653 | A1 | 12/2004 | Delplancke et al. |
| 2004/0266655 | A1 | 12/2004 | Baum et al. |
| 2005/0019352 | A1 | 1/2005 | Mercier et al. |
| 2005/0028293 | A1 | 2/2005 | Geffroy |
| 2005/0108832 | A1 | 5/2005 | Torri et al. |
| 2005/0143278 | A1 | 6/2005 | Pegelow et al. |
| 2005/0171287 | A1 | 8/2005 | Baum et al. |
| 2005/0175572 | A1 | 8/2005 | Nguyen-Kim et al. |
| 2005/0176878 | A1 | 8/2005 | Ettl et al. |
| 2005/0202985 | A1 | 9/2005 | Nieendick et al. |
| 2005/0202989 | A1 | 9/2005 | Wilson |
| 2005/0256027 | A1 | 11/2005 | Heibel et al. |
| 2005/0267008 | A1 | 12/2005 | Carvell et al. |
| 2005/0271595 | A1 | 12/2005 | Brown |
| 2005/0276831 | A1 | 12/2005 | Dihora et al. |
| 2006/0019847 | A1 | 1/2006 | Fan et al. |
| 2006/0019858 | A1 | 1/2006 | Kruse et al. |
| 2006/0024353 | A1 | 2/2006 | Trouve et al. |
| 2006/0029561 | A1 | 2/2006 | Gunn et al. |
| 2006/0106186 | A1 | 5/2006 | Dupont et al. |
| 2006/0111511 | A1 | 5/2006 | Narayan et al. |
| 2006/0182917 | A1 | 8/2006 | Wood et al. |
| 2006/0183203 | A1 | 8/2006 | DeAngelis |
| 2006/0183856 | A1 | 8/2006 | Wood et al. |
| 2006/0183857 | A1 | 8/2006 | Wood et al. |
| 2006/0252901 | A1 | 11/2006 | Narayan et al. |
| 2006/0258555 | A1 | 11/2006 | Filippini et al. |
| 2006/0258557 | A1 | 11/2006 | Popplewell et al. |
| 2006/0281654 | A1 | 12/2006 | Brooker et al. |
| 2007/0015678 | A1 | 1/2007 | Rodrigues et al. |
| 2007/0021577 | A1 | 1/2007 | Rodrigues et al. |
| 2007/0054816 | A1 | 3/2007 | Berthier et al. |
| 2007/0111920 | A1 | 5/2007 | Baur et al. |
| 2007/0138105 | A1 | 6/2007 | Takeda et al. |
| 2007/0260046 | A1 | 11/2007 | Tomita et al. |
| 2008/0020948 | A1 | 1/2008 | Rodrigues et al. |
| 2008/0020961 | A1 | 1/2008 | Rodrigues et al. |
| 2008/0021167 | A1 | 1/2008 | Rodrigues |
| 2008/0021168 | A1 | 1/2008 | Rodrigues et al. |
| 2008/0118568 | A1 | 5/2008 | Smets et al. |
| 2008/0139441 | A1 | 6/2008 | Xiao et al. |
| 2008/0146478 | A1 | 6/2008 | Lei et al. |
| 2008/0230193 | A1 | 9/2008 | Mori et al. |
| 2008/0274940 | A1 | 11/2008 | Tjelta et al. |
| 2008/0274942 | A1 | 11/2008 | Tjelta et al. |
| 2008/0305982 | A1 | 12/2008 | Smets et al. |
| 2008/0311064 | A1 | 12/2008 | Lei et al. |
| 2009/0011973 | A1 | 1/2009 | Besse et al. |
| 2009/0023625 | A1 | 1/2009 | Tang et al. |
| 2009/0062175 | A1 | 3/2009 | Cermenati et al. |
| 2009/0087390 | A1 | 4/2009 | Modi |
| 2009/0176687 | A1 | 7/2009 | Tjelta et al. |
| 2009/0258042 | A1 | 10/2009 | Anastasiou et al. |
| 2009/0258810 | A1 | 10/2009 | Song et al. |
| 2010/0008870 | A1 | 1/2010 | Dihora et al. |
| 2010/0056413 | A1 | 3/2010 | Harry, Jr. et al. |
| 2010/0069280 | A1 | 3/2010 | Rodrigues et al. |
| 2010/0075879 | A1 | 3/2010 | Gizaw et al. |
| 2010/0075880 | A1 | 3/2010 | Dupont et al. |
| 2010/0075887 | A1 | 3/2010 | Wang et al. |
| 2010/0086575 | A1 | 4/2010 | Dihora et al. |
| 2010/0093584 | A1 | 4/2010 | Brand et al. |
| 2010/0154831 | A1 | 6/2010 | Neplenbroek et al. |
| 2010/0167547 | A1 | 7/2010 | Kamimura |
| 2010/0236736 | A1 | 9/2010 | Brockmeyer et al. |
| 2010/0280146 | A1 | 11/2010 | Vanderlaan et al. |
| 2010/0317560 | A1 | 12/2010 | Ryther et al. |
| 2011/0017945 | A1 | 1/2011 | Miralles et al. |
| 2011/0021410 | A1 | 1/2011 | Miralles et al. |
| 2011/0021734 | A1 | 1/2011 | Samaranayake et al. |
| 2011/0028371 | A1 | 2/2011 | Rodrigues et al. |
| 2011/0118168 | A1 | 5/2011 | Schunicht et al. |
| 2011/0136718 | A1 | 6/2011 | Rodrigues et al. |
| 2012/0128608 | A1 | 5/2012 | Rodrigues et al. |
| 2012/0134942 | A1 | 5/2012 | Thomaides et al. |
| 2013/0035273 | A1 | 2/2013 | Silvernail et al. |
| 2013/0035274 | A1 | 2/2013 | Silvernail et al. |
| 2013/0035275 | A1 | 2/2013 | Silvernail et al. |
| 2013/0035276 | A1 | 2/2013 | Silvernail et al. |
| 2013/0035277 | A1 | 2/2013 | Silvernail et al. |

FOREIGN PATENT DOCUMENTS

| | | |
|---|---|---|
| EP | 0130756 | 1/1985 |
| EP | 0130759 | 1/1985 |
| EP | 0438215 | 7/1991 |
| EP | 0441197 | 8/1991 |
| EP | 0577519 | 1/1994 |
| EP | 0605084 | 7/1994 |
| EP | 0505371 | 3/1996 |
| EP | 0725131 | 8/1996 |
| EP | 0526800 | 1/1997 |
| EP | 0869169 | 10/1998 |
| EP | 0653485 | 5/2000 |
| EP | 0797656 | 5/2000 |
| EP | 0703243 | 12/2000 |
| EP | 0628655 | 5/2001 |
| EP | 1043389 | 5/2001 |
| EP | 1043388 | 12/2001 |
| EP | 1021156 | 2/2002 |
| EP | 1162257 | 2/2006 |
| EP | 1520004 | 12/2006 |
| EP | 1506765 | 7/2007 |
| EP | 1881017 | 1/2008 |
| EP | 1997874 | 3/2008 |
| EP | 1950232 | 7/2008 |
| EP | 1699429 | 10/2008 |
| EP | 2014757 | 1/2009 |
| EP | 1741775 | 4/2009 |
| EP | 2072531 | 6/2009 |
| EP | 2138560 | 12/2009 |
| EP | 1877171 | 3/2010 |
| EP | 2164940 | 3/2010 |
| EP | 2176393 | 4/2010 |
| FR | 2856073 | 12/2004 |
| FR | 2908135 | 5/2008 |
| FR | 2927083 | 8/2009 |
| GB | 1322536 | 12/1929 |
| GB | 1355998 | 9/1931 |
| GB | 1464616 | 4/1937 |
| GB | 2322137 | 8/1998 |
| GB | 2432844 | 6/2007 |
| GB | 2432852 | 6/2007 |
| JP | 57082145 | 5/1982 |
| JP | 6157253 | 6/1994 |
| JP | 6298866 | 10/1994 |
| JP | 9249892 | 9/1997 |
| JP | 11343449 | 12/1999 |
| JP | 2000017299 | 1/2000 |
| JP | 2002285019 | 10/2002 |
| JP | 2004107233 | 4/2004 |
| JP | 2005120045 | 5/2005 |
| JP | 2005532304 | 10/2005 |
| JP | 2008208051 | 9/2008 |
| JP | 2010047713 | 3/2010 |
| JP | 2011195809 | 10/2011 |
| WO | 61031497 | 2/1986 |
| WO | 9006125 | 6/1990 |
| WO | 9106637 | 5/1991 |
| WO | 9206162 | 4/1992 |
| WO | 9210433 | 6/1992 |
| WO | 9311214 | 6/1993 |
| WO | 9319038 | 9/1993 |
| WO | 9319146 | 9/1993 |
| WO | 9409099 | 4/1994 |
| WO | 9510591 | 4/1995 |
| WO | 9526393 | 10/1995 |
| WO | 9526710 | 10/1995 |
| WO | 9635645 | 11/1996 |
| WO | 9637530 | 11/1996 |
| WO | 9745510 | 12/1997 |
| WO | 9818352 | 5/1998 |
| WO | 9835002 | 8/1998 |
| WO | 9835003 | 8/1998 |

(56) References Cited

FOREIGN PATENT DOCUMENTS

| | | |
|---|---|---|
| WO | 9835004 | 8/1998 |
| WO | 9835005 | 8/1998 |
| WO | 9835006 | 8/1998 |
| WO | 9849260 | 11/1998 |
| WO | 9902663 | 1/1999 |
| WO | 9905082 | 2/1999 |
| WO | 9905084 | 2/1999 |
| WO | 9905241 | 2/1999 |
| WO | 9905242 | 2/1999 |
| WO | 9905243 | 2/1999 |
| WO | 9905244 | 2/1999 |
| WO | 9907656 | 2/1999 |
| WO | 9920726 | 4/1999 |
| WO | 9927083 | 6/1999 |
| WO | 9936470 | 7/1999 |
| WO | 0012661 | 3/2000 |
| WO | 0015180 | 3/2000 |
| WO | 0018868 | 4/2000 |
| WO | 0020470 | 4/2000 |
| WO | 0023548 | 4/2000 |
| WO | 0023549 | 4/2000 |
| WO | 0036076 | 6/2000 |
| WO | 0047708 | 8/2000 |
| WO | 0124779 | 4/2001 |
| WO | 0132816 | 5/2001 |
| WO | 0142408 | 6/2001 |
| WO | 0238715 | 5/2002 |
| WO | 0244686 | 6/2002 |
| WO | 03042262 | 5/2003 |
| WO | 03095597 | 11/2003 |
| WO | 2004046301 | 6/2004 |
| WO | 2004048418 | 6/2004 |
| WO | 2005009023 | 1/2005 |
| WO | 2005051343 | 6/2005 |
| WO | 2005068552 | 7/2005 |
| WO | 2006002565 | 1/2006 |
| WO | 2006007945 | 1/2006 |
| WO | 2006119162 | 11/2006 |
| WO | 2007140267 | 12/2007 |
| WO | 2008144744 | 11/2008 |
| WO | 2008147940 | 12/2008 |
| WO | 2009006603 | 1/2009 |
| WO | 2009087525 | 7/2009 |
| WO | 2009156233 | 12/2009 |
| WO | 2010057977 | 5/2010 |
| WO | 2010065482 | 6/2010 |
| WO | 2010065483 | 6/2010 |
| WO | 2010079466 | 7/2010 |
| WO | 2010079467 | 7/2010 |
| WO | 2011014783 | 2/2011 |
| WO | 2011025624 | 3/2011 |

OTHER PUBLICATIONS

European Search Report issued in EP Application No. 07014412, 2 pages, completed. Jan. 23, 2008.
European Search Report issued in EP Application No. 07014413, 12 pages, completed. Nov. 6, 2007.
Herman, Mark F., "Encyclopedia of Polymer Science and Technology", vol. 11, John Wiley & Sons, Inc., p. 380. Dec. 31, 2004.
International Search Report issued in PCT/US2012/049514, 3 pages, dated Feb. 19, 2013. dated Feb. 19, 2013.
International Search Report issued in PCT/US2012/049547, 4 pages, dated Jan. 23, 2013, dated Jan. 23, 2013.
International Search Report issued in PCT/US2012/049564, 4 pages, dated Jan. 23, 2013. dated Jan. 12, 2013.
International Search Report issued in PCT/US2012/049584, 4 pages, dated Jan. 21, 2013. dated Jan. 21, 2013.
International Search Report issued in PCT/US2012/049595, 3 pages, dated Feb. 25, 2013. dated Feb. 25, 2013.
International Search Report and Written Opinion issued in PCT/US2010/043919, 13 pages, dated Sep. 30, 2010. dated Sep 30, 2010.
International Search Report and Written Opinion issued in PCT/US2010/043930, 16 pages, dated Dec. 14, 2010. dated Dec. 14, 2010.
International Search Report and Written Opinion issued in PCT/US2012/049608, 13 pages, dated Mar. 22, 2013. dated Mar. 22, 2013.
Kahya, Suat, et al, "A Novel Copolymer: Starch-g-Polyvinylpyrrolidone", Starch, vol. 61, pp. 267-274. Dec. 31, 2009.
Kirk-Othmer Encyclopedia of Chemical Technology, 3rd Edition, vol. 7, John Wiley & Sons, pp. 430-447. Dec. 31, 1979.
Kroschwitz, Jacqueline I., "Concise Encyclopedia of Polymer Science and Engineering", John Wiley & Sons, Inc., p. 436. Dec. 31, 1990.
Kwei, Kwei-Ping S., et al., "Chain Transfer Constant of vinylpyrrolidone with Dextran", Institute of Polymer Research, vol. 66, pp. 828-829. May 31, 1962.
Menger, F.M., et al., "Gemini Surfactants: A New Class of Self-Assembling Molecules", J.Am. Chem. Soc. vol. 115, pp. 10083-10090. Dec. 31, 1993.
Odian, George, "Principles of Polymerization", 2nd Edition, John Wiley & Sons, Inc., p. 226. Dec. 31, 1981.
Odian, George, "Principles of Polymerization", McGraw-Hill Inc., p. 424. Dec. 31, 1970.
Pal, S. et al., "Cationic Starch: an effective flocculating agent", Carbohydrate Polymers, vol. 59, pp. 417-423. Dec. 31, 2005.
Rosen, Milton J. "Geminis: A New Generation of Surfactants", Chemtech, pp. 30-33. Mar. 31, 1993.
Shen, K.P., et al., "Graft Copolymers of Vinyl Pyrrolidone on Dextran", Journal of Polymer Science, vol. 53, pp. 81-85. Dec. 31, 1961.
Wurzburg, O.B., "Modified Starches: Properties and Uses", Chapter 10 Grafted Starches, CRC Press, Inc., 15 pages. Dec. 31, 1986.
European Search Report issued in EP Application No. 06015025, 9 pages, completed. Nov. 13, 2006.
European Search Report issued in EP Application No. 07014412, 3 pages, completed. Oct. 18, 2007.
European Search Report issued in EP Application No. 09175465, 6 pages, completed. Jan. 14, 2010.
Akzo Nobel, N.V., "Written Opinion of the International Searching Authority", 4 pages, PCT/US2010/043919, filed Jul. 30, 2010. dated Jul. 30, 2010.
Akzo Nobel, N.V., "Written Opinion of the International Searching Authority", 9 pages, PCT/US2010/043930 filed Jul. 30, 2010. dated Jul. 31, 2010.
Ecolab USA Inc., PCT/US2012/049547 filed Aug. 3, 2012, "Written Opinion of the International Searching Authority", 5 pages, dated Jan. 23, 2013. dated Jan. 23, 2013.
Ecolab USA Inc., PCT/US2012/049564 filed Aug. 3, 2012, "Written Opinion of the International Searching Authority", 4 pages, dated Jan. 23, 2013. dated Jan. 23, 2013.
Ecolab USA Inc., PCT/US2012/049584 filed Aug. 3, 2012, "Written Opinion of the International Searching Authority", 5 pages, dated Jan. 21, 2013. dated Jan. 21, 2013.
Ecolab USA Inc., PCT/US2012/049595 filed Aug. 3, 2012, "Written Opinion of the International Searching Authority", 5 pages, dated Feb. 25, 2013. dated Feb. 25, 2013.
Clariant, "Material Safety Data Sheet Genapol LA 070 S", 2 pages, date of printing Jul. 30, 2008, revision date Aug. 14, 2007. Aug. 14, 2007.
Air Products, "Material Safety Data Sheet", Version 1.4, 7 pages, print date Dec. 7, 2013, revision date Sep. 26, 2011. Sep. 26, 2011.
Clariant, "Industrial & Consumer Specialties: Home Care", 20 pages. Dec. 31, 2010.

BIO-BASED POT AND PAN PRE-SOAK

CROSS-REFERENCE TO RELATED APPLICATIONS

This application is a Continuation application of U.S. Ser. No. 14/278,773 filed May 15, 2014, which is herein incorporated by reference in its entirety.

FIELD OF THE INVENTION

The present invention relates to the field of solid compositions useful for soaking. In particular, the present invention relates to a pot and pan soaking composition having a biobased content of 58% or greater.

BACKGROUND OF THE INVENTION

Heavily soiled wares can require multiple cleaning steps to remove the soils from the surfaces of the wares. Pots and pans used for prepping, cooking, and baking ware in full service restaurants can be particularly difficult to clean in a dishmachine due to the caramelized soil baked on to the surface of the ware. Some full service restaurants have attempted to overcome this issue by using, as a pre-step to washing the pots and pans in the dishmachine, a 3-compartment sink for soaking the pots and pans. Exemplary soaking solutions include water, pot and pan detergent solutions, or silverware presoaks. Components of these compositions typically include metal protectors, surfactants, alkalinity sources and the like.

Surfactants are the single most important cleaning ingredient in cleaning products. Environmental regulations, consumer habits, and consumer practices have forced new developments in the surfactant industry to produce lower-cost, higher-performing, and environmentally friendly products.

For example Alkyl phenyl sulfonates, surfactants derived from tetrapropylene that have very complex branching structures (e.g., 3 or 4 branches per molecule), were prominent until the early 1960s when they were subjected to environmental regulations for being poorly biodegradable. Alkylphenyl sulfonate surfactants were then replaced with the readily biodegradable linear alkylphenyl sulfonate (LAS) surfactants, which are easily obtainable and currently in use today.

The materials used to produce LAS surfactants are derived from non-renewable resources, such as petroleum, natural gas, and coal. A renewable resource is produced by a natural process at a rate comparable to its rate of consumption (e.g., within a 100 year time frame). In contrast, natural resources such as crude oil, (or petroleum which refers to crude oil and its components of paraffinic, cycloparaffinic, and aromatic hydrocarbons), natural gas, coal, and peat, all take longer than 100 years to form, and are examples of non-renewable resources. Crude oil may be obtained from tar sands, bitumen fields, and oil shale.

Another frequent component in detergents and soaking compositions include metal protecting polymers such as Acrylic acid or acrylate. Acrylic acid is also commonly made from petroleum sources. For example, acrylic acid has long been prepared by catalytic oxidation of propylene. These and other methods of making acrylic acid from petroleum sources are described in the Kirk-Othmer Encyclopedia of Chemical Technology, Vol. 1, pgs. 342-369 ($5^{th}$ Ed., John Wiley & Sons, Inc., 2004). Petroleum-based acrylic acid contributes to greenhouse emissions due to its high petroleum derived carbon content.

Thus, the price and availability of the petroleum, natural gas, and coal feedstock ultimately have a significant impact on the price of many surfactants and other components commonly used in detergents. As the worldwide price of petroleum, natural gas, and/or coal escalates, so does the price of surfactants and other compositions useful in detergents. Furthermore, these resources have finite limitations for the future as they are not replenished. Some reports indicate crude oil reserves are less than 100 years, or even less than 30 years. Thus, alternatives are needed that are renewably sourced but at reasonable economics and processed in a way that uses less energy to prepare.

As used herein, "biobased content" refers to the amount of bio-carbon in a material as a percent of the weight (mass) of the total organic carbon in the product. For example, ethylene contains two carbon atoms. If ethylene is derived from a renewable resource, it has a biobased content of 100% because all of the carbon atoms are derived from a renewable resource. As used herein, a "renewable" compound or material is one that is partially or wholly derived from a renewable resource. In a partially renewable compound or material, at least one, but not all of its carbon atoms is derived from a renewable resource. In a wholly renewable compound or material, all of its carbon atoms are derived from a renewable resource.

Accordingly it is an object of the invention to provide a solid pot and pan pre-soaking composition that is at least 58% or greater bio-based content.

It is yet another object of the invention to provide a pot and pan pre-soak composition that is safe, environmentally friendly and economically feasible.

Other objects, aspects and advantages of this invention will be apparent to one skilled in the art in view of the following disclosure, the drawings, and the appended claims.

SUMMARY OF THE INVENTION

In one embodiment, the present invention is a dimensionally stable solid detergent composition which can be used as a soaking composition. The composition includes a bio-based content of 58% or greater. Bio-based content can be determined using ASTM Method D6866, entitled Standard Test Methods for Determining the Bio-based Content of Natural Range Materials Using Radiocarbon and Isotope Ratio Mass Spectrometry Analysis. More specifically, ASTM Method D6866 uses radiocarbon dating to measure the amount of new carbon present in a product as a percentage of the total organic carbon by comparing the ratio of Carbon 12 to Carbon 14. The water content of a product is not included as part of bio-based content as it contains no carbon.

In general the composition includes an alkalinity source, a metal protector, a surfactant system, water, a threshold agent, and a polysaccharide hybrid polymer component. The polysaccharide hybrid polymer component includes a polysaccharide residue present in an amount from approximately 5% to 90% by weight of the polysaccharide hybrid polymer composition and a residue of at least one ethylenically unsaturated monomer or salts thereof present in an amount from approximately 10% to 75% by weight of the polysaccharide hybrid polymer composition.

In another embodiment, the present invention is dimensionally stable solid detergent a presoak composition including between about 30% and about 80% by weight alkalinity source, between about 15% and about 35% by weight metal protector, between about 2% and about 10% by weight surfactant, between about 0.1% and about 20% by weight water, between about 0.2% and about 10% by weight threshold agent, between and between about 0.05% and about 20% a polysaccharide hybrid polymer.

In yet another embodiment, the present invention is a method of removing heavily soiled surfaces from a substrate. The method includes forming a composition having degreasing and metal protecting properties and contacting the surface of the substrate with the composition. The composition includes an alkalinity source, a metal protector, a surfactant system, water, a threshold agent, and a polysaccharide hybrid polymer.

In another embodiment, the solid detergent composition is used by mixing water with the composition to form a use solution. The substrate is contacted with the use solution. In some embodiments, the water and composition are mixed so that the use solution has a polysaccharide hybrid polymer composition concentration from about 1 part-per-million (ppm) to about 500 ppm.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

While the presently described technology will be described in connection with one or more preferred embodiments, it will be understood by those skilled in the art that the technology is not limited to only those particular embodiments. To the contrary, the presently described technology includes all alternatives, modifications, and equivalents as may be included within the spirit and scope of the appended claims.

"Cleaning" means to perform or aid in soil removal, bleaching, microbial population reduction, rinsing, or combination thereof.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, "weight percent," "wt. %," "percent by weight," "% by weight," and variations thereof refer to the concentration of a substance as the weight of that substance divided by the total weight of the composition and multiplied by 100. It is understood that, as used here, "percent," "%," and the like are intended to be synonymous with "weight percent," "wt. %," etc.

The term "about," as used herein, modifying the quantity of an ingredient in the compositions of the invention or employed in the methods of the invention refers to variation in the numerical quantity that can occur, for example, through typical measuring and liquid handling procedures used for making concentrates or use solutions; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about," the claims include equivalents to the quantities. All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

The recitation of numerical ranges by endpoints includes all numbers subsumed.

As used herein, "biobased content" refers to the amount of bio-carbon in a material as a percent of the weight (mass) of the total organic carbon in the product. For example, ethylene contains two carbon atoms. If ethylene is derived from a renewable resource, it has a biobased content of 100% because all of the carbon atoms are derived from a renewable resource.

As used herein, a "renewable" compound or material is one that is partially or wholly derived from a renewable resource. In a partially renewable compound or material, at least one, but not all of its carbon atoms is derived from a renewable resource. In a wholly renewable compound or material, all of its carbon atoms are derived from a renewable resource.

As used herein, a "renewable resource" is one that is produced by a natural process at a rate comparable to its rate of consumption (e.g., within a 100 year time frame). The resource can be replenished naturally, or via agricultural techniques. Renewable resources include plants (e.g., sugar cane, beets, corn, potatoes, citrus fruit, woody plants, lignocellulosics, hemicellulosics, cellulosic waste), animals, fish, bacteria, fungi, and forestry products. These resources can be naturally occurring, hybrids, or genetically engineered organisms. Natural resources such as crude oil, coal, and peat, which take longer than 100 years to form, are not considered renewable resources. Nonlimiting examples of renewable polymers include polymers produced directly from organisms, such as polyhydroxyalkanoates (e.g., poly (beta-hydroxyalkanoate), poly(3-hydroxybutyrate-co-3-hydroxyvalerate, NODAX™), and bacterial cellulose; polymers extracted from plants and biomass, such as polysaccharides and derivatives thereof (e.g., gums, cellulose, cellulose esters, chitin, chitosan, starch, chemically modified starch), proteins (e.g., zein, whey, gluten, collagen), lipids, lignins, and natural rubber; and polymers derived from naturally sourced monomers and derivatives, such as bio-polyethylene, polytrimethylene terephthalate, polylactic acid, NYLON 11, alkyd resins, and succinic acid-based polyesters.

The term "bio-" placed as a prefix means that at least a portion of the carbon atoms of the component are derived from a renewable resource. Also included within this definition are those components that are produced naturally in plants. For example, bio-limonene and bio-isobornyl alcohol can be harvested from various plants. While the component may be capable of being derived from petroleum feedstock, the prefix is intended to exclude those components that specifically derive all of their carbon atoms from petroleum feedstock. As an example, "bio-ethanol" means ethanol that is formed from renewable resources. Catalysts, solvents, or other adjuvants that are used to facilitate the reaction, but do not form a part of the final bio-component, do not necessarily need to be derived from a renewable resource.

As used herein, the term "biodegradable" refers to compounds and materials that are capable of undergoing natural decomposition into carbon dioxide, methane, water, inorganic compounds, biomass, or a mixture thereof, in which the predominant mechanism is the enzymatic action of microorganisms that can be measured by standardized tests, in a specified time, reflecting relevant disposal conditions. In the presence of oxygen (aerobic biodegradation), these metabolic processes yield carbon dioxide, water, biomass, and minerals. Under anaerobic conditions (anaerobic biodegradation), methane may additionally be produced.

The term "commercially acceptable cleaning performance" refers generally to the degree of cleanliness, extent of effort, or both that a typical consumer would expect to achieve or expend when using a cleaning product or cleaning system to address a typical soiling condition on a typical substrate. This degree of cleanliness may, depending on the particular cleaning product and particular substrate, correspond to a general absence of visible soils, or to some lesser degree of cleanliness. For example, a shower cleaner or toilet bowl cleaner would be expected by a typical consumer to achieve an absence of visible soils when used on a moderately soiled but relatively new hard surface, but would not be expected to achieve an absence of visible soils when used on an old hard surface which already bears permanent stains such as heavy calcite deposits or iron discoloration. Cleanliness may be evaluated in a variety of ways depending on the particular cleaning product being used (e.g., ware or laundry detergent, pre-soak, hard surface cleaner, vehicular wash or pre-soak agent, or the like) and the particular hard or soft surface being cleaned (e.g., ware, laundry, fabrics, vehicles, and the like), and normally may be determined using generally agreed industry standard tests or localized variations of such tests. In the absence of such agreed industry standard tests, cleanliness may be evaluated using the test or tests already employed by a manufacturer or seller to evaluate the cleaning performance of its phosphorus-containing cleaning products sold in association with its brand.

As used herein, the term "substantially free" refers to compositions completely lacking the component or having such a small amount of the component that the component does not affect the effectiveness of the composition. The component may be present as an impurity or as a contaminant and shall be less than 0.5 wt. %. In another embodiment, the amount of the component is less than 0.1 wt-% and in yet another embodiment, the amount of component is less than 0.01 wt. %.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both, when using the substitute cleaning product or substitute cleaning system rather than a branded phosphorus-containing cleaning to address a typical soiling condition on a typical substrate. This degree of cleanliness may, depending on the particular cleaning product and particular substrate, correspond to a general absence of visible soils, or to some lesser degree of cleanliness, as explained in the prior paragraph.

The term "hard surface" refers to a non-resilient cleanable substrate, for example materials made from ceramic, stone, glass or hard plastics including showers, sinks, toilets, bathtubs, countertops, windows, mirrors, transportation vehicles, walls, wooden or tile floors, patient-care equipment (for example diagnostic equipment, shunts, body scopes, wheel chairs, bed frames, etc.), surgical equipment and the like.

The term "improved cleaning performance" refers generally to achievement by a substitute cleaning product or substitute cleaning system of a generally greater degree of cleanliness or with generally a reduced expenditure of effort, or both, when using the substitute cleaning product or substitute cleaning system rather than a branded phosphorus-containing cleaning product to address a typical soiling condition on a typical substrate. This degree of cleanliness may, depending on the particular cleaning product and particular substrate, correspond to a general absence of visible soils, or to some lesser degree of cleanliness, as explained above.

The terms "include" and "including" when used in reference to a list of materials refer to but are not limited to the materials so listed.

The term "soft surface" refers to a resilient cleanable substrate, for example materials made from woven, nonwoven or knit textiles, leather, rubber or flexible plastics including fabrics (for example surgical garments, draperies, bed linens, bandages, etc.), carpet, transportation vehicle seating and interior components and the like.

The term "solid" refers to a composition in a generally shape-stable form under expected storage conditions, for example a powder, particle, agglomerate, flake, granule, pellet, tablet, lozenge, puck, briquette, brick or block, and whether in a unit dose or a portion from which measured unit doses may be withdrawn. A solid may have varying degrees of shape stability, but typically will not flow perceptibly and will substantially retain its shape under moderate stress, pressure or mere gravity, as for example, when a molded solid is removed from a mold, when an extruded solid exits an extruder, and the like. A solid may have varying degrees of surface hardness, and for example may range from that of a fused solid block whose surface is relatively dense and hard, resembling concrete, to a consistency characterized as being malleable and sponge-like, resembling a cured caulking material.

The term "water soluble" refers to a compound that can be dissolved in water at a concentration of more than 1 wt. %. The terms "sparingly soluble" or "sparingly water soluble" refer to a compound that can be dissolved in water only to a concentration of 0.1 to 1.0 wt. %. The term "water insoluble" refers to a compound that can be dissolved in water only to a concentration of less than 0.1 wt. %.

Soaking Composition

The present invention relates to a soaking composition and methods of using the soaking composition to remove grease and food soils from surfaces without significant corrosive or detrimental effects on the aesthetics of such surfaces. In addition to loosening greasy, baked on soils, the soaking solution also protects the surface of the ware both while soaking in the soaking composition and while passing through a dishmachine. Moreover, the soaking composition is low foaming to allow compatibility with a dishmachine and does not irritate skin. The soaking composition is used to loosen grease and food soils on ware, such as pots and pans, before the pots and pans are run through a dishmachine. The soaking step reduces the number of washes soiled ware must undergo to remove the soils when compared to not using a soaking composition, soaking with water, or soaking with a manual detergent. The composition is greater than 58% biobased and in certain embodiments may also be substantially free of phosphoric acid. The soaking composition can be used on ware made of various materials, including, for example: stainless steel, aluminum, cast iron and plastics. A particularly suitable application for the soaking composition is removing grease and organic soils from pots and pans.

The soaking composition loosens grease and soil from the surface such that the soil is substantially removed from the surface when the ware is passed through a single cycle of a dishmachine. In addition, no personal protective equipment is needed when the soaking composition is used at the recommended concentration and with the recommended procedures.

The soaking composition provides metal protection for metal ware and prevents discoloration when soaked in the soaking composition for extended soak times at the recommended detergent concentration. Ware immersed in the soaking composition can soak overnight with minimal to no discoloration. For example, Aluminum 3003 and 6061 can be soaked in the soaking solution for extended soak times at the recommended detergent concentration without causing noticeable blackening or discoloration.

Typically, when ware is soaked in a solution and then removed and placed into a dishmachine, a small quantity of the soaking solution is carried with the ware. Because the soaking composition is used prior to placing the ware in a dishmachine for cleaning, components in the soaking composition may produce foam. The soaking composition is formulated to produce lower foam than typical pot and pan detergents when agitated. This lower foaming property allows the soaking composition to be used in combination with a dishmachine without excessive carryover.

The soaking composition can be provided in solid or liquid form and includes an alkalinity source, a metal protector, a surfactant or surfactant system, water, a threshold agent, and a polysaccharide polymer. The composition may also include a scale inhibitor. 30% and about 80% by weight alkalinity source, between about 15% and about 35% by weight metal protector, between about 2% and about 10% by weight surfactant, between about 0.1% and about 20% by weight water, between about 0.2% and about 15% by weight threshold agent, between and between about 0.05% and about 20% by weight a polysaccharide hybrid polymer. If a scale inhibitor is present it is present in an amount of from about 0 to about 15% by weight.

Particularly, the solid soaking composition includes between about 40% and about 70% by weight alkalinity source, between about 18% and about 30% by weight metal protector, between about 4% and about 8% by weight surfactant, between about 0.15% and about 10% by weight water, between about 0.4% and about 10% by weight threshold agent, and between about 1% and about 10% by weight of a saccharide polymer. If a scale inhibitor is present in an amount of about 1% to 10% by weight. In other embodiments, similar intermediate concentrations and use concentrations may also be present in the soaking compositions of the invention.

When provided as a liquid composition, the soaking composition includes an increased amount of water. In one embodiment, the liquid soaking composition includes between about 40% and about 70% water and particularly between about 50% and about 70% water.

Components of the Soaking Composition

Source of Alkalinity

The alkalinity source of the soaking composition can include, for example, an alkali metal hydroxide, alkali metal carbonate, or alkali metal silicate. Examples of suitable alkalinity sources include, but are not limited to: sodium hydroxide, potassium hydroxide, sodium carbonate, potassium carbonate or a mixture of alkali metal sodium hydroxide and alkali metal carbonate. The alkalinity source controls the pH of the resulting solution when water is added to the detergent composition to form a use solution. The pH of the use solution must be maintained in the alkaline range in order to provide sufficient detergency properties. In one embodiment, the pH of the use solution is between approximately 9 and approximately 12. Particularly, the pH of the use solution is about 10. If the pH of the use solution is too low, for example, below approximately 9, the use solution may not provide adequate detergency properties. If the pH of the use solution is too high, for example, above approximately 13, the use solution may be too alkaline and attack or damage the surface to be cleaned.

The alkalinity source may also function as a hydratable salt to form the solid cast. The hydratable salt can be referred to as substantially anhydrous. By substantially anhydrous, it is meant that the component contains less than about 2% by weight water based upon the weight of the hydratable component. The amount of water can be less than about 1% by weight, and can be less than about 0.5% by weight. There is no requirement that the hydratable component be completely anhydrous.

Metal Protector

The soaking composition of the present invention includes a metal protector or corrosion inhibitor such that the soaking composition is safe to use with metals. For example, the soaking composition is safe to use on aluminum-based products. Examples of suitable metal protectors include, but are not limited to, a combination of a source of aluminum ion and a source of zinc ion, as well as an alkaline metal silicate or hydrate thereof. An example of a particularly suitable metal protector includes, but is not limited to, sodium silicate. Exemplary metals that can be used with the soaking composition include Aluminum 3003 and Aluminum 6061.

Surfactant

The soaking composition also includes a surfactant or surfactant system. The surfactant or surfactant system of the soaking composition functions to degrease, emulsify and penetrate the soils. The surfactant or surfactant system may include anionic, nonionic, cationic, and zwitterionic surfactants. Because the soaking composition is intended to be used in an automatic dishwashing or warewashing machine, the surfactants selected are those that provide an acceptable level of foaming when used inside a dishwashing or warewashing machine. Low foaming surfactants that provide the desired level of detersive activity are advantageous in environments where the presence of large amounts of foaming can be problematic, such as in a dishwashing machine. Accordingly, surfactants that are considered low foaming surfactants can be used. In addition, other surfactants can be used in conjunction with a defoaming agent to control the level of foaming. For a discussion of surfactants, see Kirk-Othmer, Encyclopedia of Chemical Technology, Third Edition, volume 8, pages 900-912, which is incorporated herein by reference.

In one embodiment, the surfactant system includes low foaming, nonionic surfactants such that the soaking composition is dishmachine compatible. Examples of suitable nonionic surfactants include, for example, an alcohol ethoxylate made from a $C_{12}$-$C_{14}$ linear alcohol with 3 moles ethylene oxide and a 7 mole ethoxylate of a linear, primary $C_{12}$-$C_{14}$ alcohol.

Examples of commercially available bio-based nonionic surfactants include, but are not limited to Genapol LA 030 and Genapol LA 070S available from Clariant, and, Tomadol L 80 and Tomadol L124 available from Air Products (formerly Tomah Products), Milton, Wis., Surfonic L24-7.

Water

Water may be independently added to the soaking composition or may be provided as a result of its presence in an aqueous material that is added to the soaking composition. For example, materials added to the soaking composition may include water or may be prepared in an aqueous premix available for reaction with the soaking composition component(s). Typically, water is introduced into the soaking composition to provide the soaking composition with a desired viscosity for processing prior to solidification and to provide a desired rate of solidification. The water may also be present as a processing aid and may be removed or become water of hydration. The water may thus be present in the form of aqueous solutions of the soaking composition, or aqueous solutions of any of the other ingredients, and/or added aqueous medium as an aid in processing. In addition, it is expected that the aqueous medium may help in the solidification process when it is desired to form the concentrate as a solid. The water may also be provided as deionized water or as softened water.

The amount of water in the resulting solid soaking composition will depend on whether the solid soaking composition is processed through forming techniques or casting (solidification occurring within a container) techniques. In general, when the components are processed by forming techniques, it is believed that the solid soaking composition can include a relatively smaller amount of water for solidification compared with the casting techniques. When preparing the solid soaking composition by forming techniques, water may be present in ranges of between about 0.1% and about 0% by weight, particularly between about 0.5% and about 20% by weight, and more particularly between about 1% and about 15% by weight.

Threshold Agent

The soaking composition can include one or more threshold agents, also called chelating or sequestering agents (e.g., builders). Exemplary threshold agents include, but are not limited to: organic phosphonate, aminocarboxylic acid, condensed phosphate, inorganic builder, polymeric polycarboxylate, mixture thereof, or the like. In addition, when sodium citrate is included in the solid soaking composition, the sodium citrate may also function as a builder. In general, a chelating agent is a molecule capable of coordinating (i.e., binding) the metal ions commonly found in natural water to prevent the metal ions from interfering with the action of the other detersive ingredients of a cleaning composition.

Examples of condensed phosphates include, but are not limited to: sodium and potassium orthophosphate, sodium and potassium pyrophosphate, sodium tripolyphosphate, and sodium hexametaphosphate. A condensed phosphate may also assist, to a limited extent, in solidification of the soaking composition by fixing the free water present in the composition as water of hydration.

Examples of phosphonates include, but are not limited to: 1-hydroxyethane-1,1-diphosphonic acid, $CH_2C(OH)[PO(OH)_2]_2$; aminotri(methylenephosphonic acid), $N[CH_2PO(OH)_2]_3$; aminotri(methylenephosphonate), sodium salt (ATMP), $N[CH_2PO(ONa)_2]_3$; 2-hydroxyethyliminobis (methylenephosphonic acid), $HOCH_2CH_2N[CH_2PO(OH)_2]_2$; diethylenetriaminepenta(methylenephosphonic acid), $(HO)_2POCH_2N[CH_2CH_2N[CH_2PO(OH)_2]_2]_{-2}$; diethylenetriaminepenta(methylenephosphonate), sodium salt (DTPMP), $C_9H_{(28-x)}N_3Na_xO_{15}P_5$ (x=7); hexamethylenediamine(tetramethylenephosphonate), potassium salt, $C_{10}H_{(28-x)}N_2K_xO_{12}P_4$ (x=6); bis(hexamethylene)triamine (pentamethylenephosphonic acid), $(HO_2)POCH_2N[(CH_2)_2N[CH_2PO(OH)_2]_2]_{-2}$; and phosphorus acid, $H_3PO_3$. A particularly suitable phosphonate includes, but is not limited to, ATMP. A neutralized or alkaline phosphonate, or a combination of the phosphonate with an alkali source prior to being added into the mixture such that there is little or no heat or gas generated by a neutralization reaction when the phosphonate is added is preferred.

The soaking composition can contain a non-phosphorus based threshold agent. Although various components may include trace amounts of phosphorous, a composition that is considered free of phosphorous generally does not include phosphate or phosphonate builder or chelating components as an intentionally added component. Carboxylates such as citrate or gluconate are suitable. Useful aminocarboxylic acid materials containing little or no NTA include, but are not limited to: N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), and other similar acids having an amino group with a carboxylic acid substituent The soaking composition of the present invention is substantially free of phosphorus-containing compounds, making the detergent composition more environmentally acceptable. Phosphorus-free refers to a composition, mixture, or ingredients to which phosphorus-containing compounds are not added. Should phosphorus-containing compounds be present through contamination of a phosphorus-free composition, mixture, or ingredient, the level of phosphorus-containing compounds in the resulting composition is less than approximately 1 wt %, less than approximately 0.5 wt %, less than approximately 0.25 wt % and often less than approximately 0.1 wt %.

Accordingly, soaking compositions which are substantially free of phosphorus (phosphate) and which, in addition, are less corrosive to metal surfaces, do not produce aesthetic defects on metal surfaces, and are low-foaming fall within the scope of the present invention.

Polysaccharide Polymer

The solid detergent compositions generally include a polysaccharide hybrid polymer component, water and a hydratable salt. The polysaccharide hybrid polymer composition includes residue of a polysaccharide and residue of at least one ethylenically unsaturated monomer or salts thereof. In some embodiments, the polysaccharide hybrid polymer is anionic. In another embodiment the polysaccharide hybrid polymer is a copolymer.

The polysaccharide hybrid polymer compositions of the present invention are produced by polymerizing with free radical initiators at least one ethylenically unsaturated monomer in the presence of the polysaccharide as a chain transfer agent, such as described in U.S. Pat. No. 7,666,963 and PCT Publication No. WO 2011/014783, each of which is incorporated by reference in its entirety herein. The polymerization is initiated by a non-metal or a non-metal ion initiator, such as inorganic peroxides including, but not limited to, hydrogen peroxide, sodium persulfate, potassium persulfate and ammonium persulfate.

As described herein, a "hybrid polymer composition" is a mixture of (a) a hybrid synthetic polymer and (b) a hybrid polymer. The hybrid polymer composition of the present invention thus contains at least the two moieties, (a) and (b), with a minimum amount of the hybrid synthetic polymer (a) since this component generates the chain transfer which leads to the formation of the hybrid polymer (b). One skilled in the art will recognize that the hybrid polymer composition may contain a certain amount of the unreacted naturally derived hydroxyl containing chain transfer agent. Suitable hybrid polymer compositions are described in PCT Publication No. WO 2011/014783. The term "hybrid polymer", as defined herein, refers to a polymer of ethylenically unsaturated monomers with an end group containing the naturally derived hydroxyl containing chain transfer agent which is a result of the hybrid synthetic polymer chain transfer. Also as used herein, the term "hybrid synthetic polymer" is a synthetic polymer derived from synthetic monomers with a hybrid initiator fragment as one end group. The other end group is a proton resulting from chain transfer to the naturally derived hydroxyl containing chain transfer agent. As used herein, the term "synthetic monomer" means any ethylenically unsaturated monomer which can undergo free radical polymerization. In an embodiment, the hybrid polymer composition suitable for use in this invention is an anionic hybrid polymer composition.

Polymerization may change a component from its original structure to a derivative structure. As used herein, the term "residue" refers to the starting component or anything derived from the component during polymerization which is part of the polymer. For example, a residue of acrylic acid includes acrylic acid and anything derived from acrylic acid during polymerization which is part of the polymer. In one example, the polysaccharide hybrid polymer composition can have a weight average molecular weight from about 2,000 g/mol to about 25,000 g/mol, in other embodiments from about 5,000 g/mol to about 20,000 g/mol and in yet another embodiment from about 7,000 to about 15,000 g/mol. The weight average molecular weight may be determined by several methods, with Gel Permeation Chromatography (GPC) using the appropriate methods and standards as the preferred method.

The residue of a polysaccharide includes a polysaccharide and anything derived from the polysaccharide during polymerization which is part of the polysaccharide hybrid polymer composition. Suitable polysaccharides can be derived from plant, animal and microbial sources. Example polysaccharides include but are not limited to maltodextrins, starches, cellulose, gums (e.g., gum arabic, guar and xanthan), alginates, pectin and gellan. Suitable starches include those derived from maize, potato, tapioca, wheat, rice, pea, sago, oat, barley, rye, and amaranth, including conventional hybrids or genetically engineered materials. Additional example polysaccharides include hemicellulose or plant cell wall polysaccharides such as D-xylans.

The polysaccharides can be modified or derivatized by etherification (e.g., via treatment with propylene oxide, ethylene oxide, 2,3-epoxypropyltrimethylammonium chloride), esterification (e.g., via reaction with acetic anhydride, octenyl succinic anhydride ('OSA')), acid hydrolysis, dextrinization, oxidation or enzyme treatment (e.g., starch modified with α-amylase, β-amylase, pullanase, isoamylase or glucoamylase), or various combinations of these treatments.

The polysaccharide hybrid polymer composition also includes residue of at least one ethylenically unsaturated monomer or salts thereof. In some examples, the at least one ethylenically unsaturated monomer can include at least one anionic ethylenically unsaturated monomer. Examples of anionic ethylenically unsaturated monomers include but are not limited to acrylic acid, methacrylic acid, ethacrylic acid, α-chloro-acrylic acid, α-cyano acrylic acid, β-methylacrylic acid (crotonic acid), α-phenyl acrylic acid, β-acryloxy propionic acid, sorbic acid, α-chloro sorbic acid, angelic acid, cinnamic acid, p-chloro cinnamic acid, β-styryl acrylic acid (1-carboxy-4-phenyl butadiene-1,3), itaconic acid, maleic acid, citraconic acid, mesaconic acid, glutaconic acid, aconitic acid, fumaric acid, tricarboxy ethylene, 2-acryloxypropionic acid, 2-acrylamido-2-methyl propane sulfonic acid, vinyl sulfonic acid, sodium methallyl sulfonate, sulfonated styrene, allyloxybenzene sulfonic acid and maleic acid. The anionic ethylenically unsaturated monomers may include half esters of maleic and itaconic acid such as monomethyl, monoethyl, monopropyl, monobutyl, monoisopropyl and monotertbutyl maleate, and monomethyl, monoethyl, monopropyl, monobutyl, monoisopropyl and monotertbutyl itaconate. Moieties such as maleic anhydride or acrylamide that can be derivatized to an acid containing group can be used. Combinations of anionic ethylenically unsaturated monomers can also be used. In a preferred embodiment, the anionic ethylenically unsaturated monomers include acrylic acid, maleic acid, methacrylic acid, 2-acrylamido-2-methyl propane sulfonic acid, monomethyl maleate and/or mixtures thereof or their salts. In a more preferred embodiment, the acid-containing monomers are acrylic acid and/or methacrylic acid. As an example, the anionic polysaccharide hybrid polymer composition includes acrylic acid residue. The residue of acrylic and methacrylic acid may be derived from acrylic and methacrylic acid monomers or may be generated from a hydrolyzable monomer. For example, a methacrylic acid residue may be partially or completely hydrolyzed from methyl methacrylate. The residues of acrylic acid and methacrylic acid may also be present as lithium, sodium, and potassium salts, ammonium and amine salts. The polysaccharide hybrid polymer composition may optionally include residue of another ethylenically unsaturated monomers. In an embodiment, such other ethylenically unsaturated monomers are hydrophilic. Examples of other ethylenically unsaturated monomers include but are not limited to hydroxyalkyl (meth)acrylate or dialkyl maleate or dialkyl itaconate. A residue of hydroxyalkyl (meth)acrylate includes both hydroxyalkyl acrylate and hydroxyalkyl methacrylate. Examples of suitable hydroxyalkyl (meth)acrylates include but are not limited to hydroxymethyl, hydroxyethyl, hydroxypropyl, hydroxybutyl, hydroxyisopropyl and hydroxytertbutyl (meth)acrylates. Suitable dialkyl maleates include but are not limited to diethyl, dipropyl, dibutyl, diisopropyl and ditertbutyl maleate. Suitable dialkyl itaconates include but are not limited monomethyl, monoethyl, monopropyl, monobutyl, monoisopropyl and monotertbutyl itaconate.

The polysaccharide hybrid polymer composition may optionally include residue of more than one ethylenically unsaturated monomer. In an embodiment, the polysaccharide hybrid polymer composition includes residue of two ethylenically unsaturated monomers present in the polysaccharide hybrid polymer composition in weight ratios from about 1:5 to about 5:1. In a preferred embodiment, acrylic acid and maleic acid are present in the polysaccharide hybrid polymer composition in weight ratios from about 1:5 to about 5:1.

A suitable concentration range of the components of the polysaccharide hybrid polymer composition include from about 5% to 90% by weight polysaccharide residue and from about 10% to about 75% by weight of at least one ethylenically unsaturated monomer. A particularly suitable concentration range of the components in the polysaccharide hybrid polymer composition include from about 30% to about 80% by weight polysaccharide residue and from about 10% to about 70% by weight residue of at least one ethylenically unsaturated monomer, and more particularly from about 40% to about 70% by weight polysaccharide residue and from about 10% to about 50% by weight residue of at least one ethylenically unsaturated monomer. The component weight percentages of the polysaccharide hybrid polymer composition given above and in the examples are based on the amounts of the respective ingredients as originally added to the hybrid polymer composition. One skilled in the art will recognize that the weight percent of each component in the final polysaccharide hybrid polymer composition may vary due to the polymerization process.

Optionally, the polysaccharide hybrid polymer composition may include from about 0.5% to about 20%, and more preferably from about 1% to about 10%, by weight residue of hydroxyalkyl (meth)acrylate, and/or from about 1% to about 25%, and more preferably from about 2% to about 15%, by weight residue of mono or dialkyl maleate.

The polysaccharide hybrid polymer composition is a bio-based and/or biodegradable polymer, which reduces the reliance on natural gas and/or petrochemical feedstocks. Biobased content is the amount of biobased carbon in a material or product and can be expressed as a percent of weight (mass) of the total organic carbon in the product. The biobased content can be determined using ASTM Method D6866, entitled Standard Test Methods for Determining the Biobased Content of Natural Range Materials Using Radiocarbon and Isotrope Ratio Mass Spectrometry Analysis. Biodegradability measures the ability of microorganisms present in the disposal environment to completely consume the biobased carbon product within a reasonable time frame and in a specified environment. Biodegradability of plastic materials can be determined using ASTM Method D5338, entitled Test Method for Determining Aerobic Biodegradation of Plastic Materials Under Controlled Composting Conditions. In one example, the polysaccharide hybrid polymer composition can include a polysaccharide and a reduced level of petrochemicals. For example, the detergent composition may include at least about 10 wt % biobased content. In another example, the detergent composition may include from about 10 wt % to about 80 wt % biobased content by weight. In another example, the detergent composition may include from about 15 wt % to about 75 wt % biobased content by weight.

Additional Functional Materials

The soaking composition can include additional components or agents, such as additional functional materials. As such, in some embodiments, the soaking composition including the alkalinity source, a metal protector, a surfactant or surfactant system, water, a threshold agent, a binding agent and a polymer blend may provide a large amount, or even all of the total weight of the soaking composition, for example, in embodiments having few or no additional functional materials disposed therein. The functional materials provide desired properties and functionalities to the cleaning composition. For the purpose of this application, the term "functional materials" include a material that when dispersed or dissolved in a use and/or concentrate solution, such as an aqueous solution, provides a beneficial property in a particular use. Some particular examples of functional materials are discussed in more detail below, but it should be understood by those of skill in the art and others that the particular materials discussed are given by way of example only, and that a broad variety of other functional materials may be used. For example, many of the functional materials discussed below relate to materials used in soaking applications, but it should be understood that other embodiments may include functional materials for use in other applications.

Binding Agent

The soaking composition of the present invention includes a binding agent to aid in solidifying the composition and binding the components together. While the actual solidification mechanism occurs through ash hydration, or the interaction of the alkalinity source (e.g., sodium carbonate) with water, it is believed that the binding agent functions to control the kinetics and thermodynamics of the solidification process and provides a solidification matrix in which additional functional materials may be bound to form a functional solid composition. In general, an effective amount of binding agent is considered an amount that effectively controls the kinetics and thermodynamics of the solidification system by controlling the rate and movement of water. An example of a particularly suitable binding agent includes, but is not limited to, sodium citrate.

Enzymes

Enzymes that can be included in the soaking composition include those enzymes that aid in the removal of starch and/or protein stains. Exemplary types of enzymes include, but are not limited to: proteases, alpha-amylases, and mixtures thereof. Exemplary proteases that can be used include, but are not limited to: those derived from *Bacillus licheniformix, Bacillus lenus, Bacillus alcalophilus*, and *Bacillus amyloliquefacins*. Exemplary alpha-amylases include *Bacillus subtilis, Bacillus amyloliquefaceins* and *Bacillus licheniformis*. The concentrate need not include an enzyme, but when the concentrate includes an enzyme, it can be included in an amount that provides the desired enzymatic activity when the solid soaking composition is provided as a use composition. Exemplary ranges of the enzyme in the concentrate include up to approximately 15% by weight, between approximately 0.5% to approximately 10% by weight, and between approximately 1% to approximately 5% by weight.

Defoaming Agents

The soaking composition can include a defoaming agent to reduce the stability of foam and reduce foaming. When the concentrate includes a defoaming agent, the defoaming agent can be provided in an amount of between about 0.01 wt. % and about 3 wt. %.

Examples of defoaming agents that can be used in the soaking composition include ethylene oxide/propylene block copolymers such as those available under the name Pluronic N3, silicone compounds such as silica dispersed in polydimethylsiloxane, polydimethylsiloxane, and functionalized polydimethylsiloxane such as those available under the name Abil B9952, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein for all purposes.

Dyes and Fragrances

Various dyes, odorants including perfumes, and other aesthetic enhancing agents may also be included in the soaking composition. Dyes may be included to alter the appearance of the composition, as for example, any of a variety of FD&C dyes, D&C dyes, and the like. Additional suitable dyes include Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Aniline and Chemical), Metanil Yellow (Keystone Aniline and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), Pylakor Acid Bright Red (Pylam), and the like. Fragrances or perfumes that may be included in the compositions include, for example, terpenoids such as citronellol, aldehydes such as amyl cinnamaldehyde, a jasmine such as CIS-jasmine or jasmal, vanillin, and the like.

Processing and/or Manufacturing of the Composition

In general, a soaking composition using the components of the present invention can be created by combining a powder premix and a liquid premix The powder and liquid premixes are then combined together to form the solid soaking composition, which is then solidified by any of a number of means, preferably by pressing.

In one embodiment the surfactants, solids and liquids are all mixed separately. Then all three components are mixed together in a mixer.

By the term "solid form", it is meant that the hardened composition will not flow and will substantially retain its shape under moderate stress or pressure or mere gravity. The degree of hardness of the solid composition may range from that of a fused solid product which is relatively dense and hard, for example, like concrete, to a consistency characterized as being a hardened paste. In addition, the term "solid" refers to the state of the soaking composition under the expected conditions of storage and use of the solid soaking composition. In general, it is expected that the solid composition will remain in solid form when exposed to temperatures of up to approximately 100° F. and particularly greater than approximately 120° F.

Although the soaking composition is discussed as being formed into a solid product, the soaking composition may also be provided in the form of a paste. When the concentrate is provided in the form of a paste, enough water is added to the soaking composition such that complete solidification of the soaking composition is precluded. In addition, dispersants and other components may be incorporated into the soaking composition in order to maintain a desired distribution of components.

The present solid composition can be made by an advantageous method of pressing the solid composition. Specifically, in a forming process, the liquid and solid components are introduced into the final mixing system and are continuously mixed until the components form a substantially homogeneous semi-solid mixture in which the components are distributed throughout its mass. In an exemplary embodiment, the components are mixed in the mixing system for at least approximately 5 seconds. The mixture is then discharged from the mixing system into, or through, a die, press or other shaping means. The product is then packaged. In an exemplary embodiment, the solid formed composition begins to harden between approximately 1 minute and approximately 3 hours. Particularly, the formed composition begins to harden in between approximately 1 minute and approximately 2 hours. More particularly, the formed composition begins to harden in between approximately 1 minute and approximately 20 minutes.

Pressing can employ low pressures compared to conventional pressures used to form tablets or other conventional solid compositions. For example, in an embodiment, the present method employs a pressure on the solid of only less than or equal to about 1000 psi. In certain embodiments, the present method employs pressures of less than or equal to about 900 psi, less than or equal to about 800 psi, or less than or equal to about 700 psi. In certain embodiments, the present method can employ pressures as low as greater than or equal to about 1 psi, greater than or equal to about 2, greater than or equal to about 5 psi, or greater than or equal to about 10 psi. In certain embodiments, the present method can employ pressures of about 1 to about 1000 psi, about 2 to about 900 psi, about 5 psi to about 800 psi, or about 10 psi to about 700 psi.

The method of the present invention can produce a stable solid without employing a melt and solidification of the melt as in conventional casting. Forming a melt requires heating a composition to melt it. The heat can be applied externally or can be produced by a chemical exotherm (e.g., from mixing caustic (sodium hydroxide) and water). Heating a composition consumes energy. Handling a hot melt requires safety precautions and equipment. Further, solidification of a melt requires cooling the melt in a container to solidify the melt and form the cast solid. Cooling requires time and/or energy. In contrast, the present method can employ ambient temperature and humidity during solidification or curing of the present compositions. Caustic compositions made according to the present method produce only a slight temperature increase due to the exotherm. The solids of the present invention are held together not by solidification from a melt but by a binding agent produced in the admixed particles and that is effective for producing a stable solid.

The method of the present invention can produce a stable solid without extruding to compress the mixture through a die. Conventional processes for extruding a mixture through a die to produce a solid composition apply high pressures to a solid or paste to produce the extruded solid. In contrast, the present method employs pressures on the solid of only less than or equal to about 1000 psi.

While the invention advantageously may be formed to solid by pressing, other methods of solid formation may also be used such as extrusion, cast molding and the like.

In an exemplary embodiment, a single- or twin-screw extruder may be used to combine and mix one or more components agents at high shear to form a homogeneous mixture. In some embodiments, the processing temperature is at or below the melting temperature of the components. The processed mixture may be dispensed from the mixer by pressing, forming, extruding or other suitable means, whereupon the composition hardens to a solid form. The structure of the matrix may be characterized according to its hardness, melting point, material distribution, crystal structure, and other like properties according to known methods in the art. Generally, a solid composition processed according to the method of the invention is substantially homogeneous with regard to the distribution of ingredients throughout its mass and is dimensionally stable.

The resulting solid composition may take forms including, but not limited to: an extruded, molded or formed solid pellet, block, tablet, powder, granule, flake; or the formed solid can thereafter be ground or formed into a powder, granule, or flake. In an exemplary embodiment, extruded pellet materials formed have a weight of between approximately 50 grams and approximately 250 grams, extruded solids have a weight of approximately 100 grams or greater, and solid blocks formed have a mass of between approximately 1 and approximately 10 kilograms. The solid compositions provide for a stabilized source of functional materials. In a preferred embodiment, the solid composition may be dissolved, for example, in an aqueous or other medium, to create a concentrated and/or use solution. The solution may be directed to a storage reservoir for later use and/or dilution, or may be applied directly to a point of use.

In certain embodiments, the solid composition is provided in the form of a unit dose. A unit dose refers to a solid composition unit sized so that the entire unit is used during a single washing cycle. When the solid cleaning composition is provided as a unit dose, it can have a mass of about 1 g to about 50 g. In other embodiments, the composition can be a solid, a pellet, or a tablet having a size of about 50 g to 250 g, of about 100 g or greater, or about 40 g to about 11,000 g.

In other embodiments, the solid composition is provided in the form of a multiple-use solid, such as, a block or a plurality of pellets, and can be repeatedly used to generate aqueous pre-soak compositions for multiple washing cycles. In certain embodiments, the solid composition is provided as a solid having a mass of about 5 g to 10 kg. In certain embodiments, a multiple-use form of the solid composition has a mass of about 1 to 10 kg. In further embodiments, a multiple-use form of the solid composition has a mass of about 5 kg to about 8 kg. In other embodiments, a multiple-use form of the solid composition has a mass of about 5 g to about 1 kg, or about 5 g and to 500 g.

Packaging System

The solid composition can be, but is not necessarily, incorporated into a packaging system or receptacle. The packaging receptacle or container may be rigid or flexible, and include any material suitable for containing the compositions produced, as for example glass, metal, plastic film or sheet, cardboard, cardboard composites, paper, or the like. The soaking compositions may be allowed to solidify in the packaging or may be packaged after formation of the solids in commonly available packaging and sent to distribution center before shipment to the consumer.

For solids, advantageously, in at least some embodiments, since the pre-soak composition is processed at or near ambient temperatures, the temperature of the processed mixture is low enough so that the mixture may be cast or extruded directly into the container or other packaging system without structurally damaging the material. As a result, a wider variety of materials may be used to manufacture the container than those used for compositions that processed and dispensed under molten conditions. In some embodiments, the packaging used to contain the soaking composition is manufactured from a flexible, easy opening film material.

Dispensing/Use of the Soaking Composition

The soaking composition can be dispensed as a concentrate or as a use solution. In addition, the soaking composition concentrate can be provided in a solid form or in a liquid form. In general, it is expected that the concentrate will be diluted with water to provide the use solution that is then supplied to the surface of a substrate. In some embodiments, the aqueous use solution may contain about 2,000 parts per million (ppm) or less active materials, or about 1,000 ppm or less active material, or in the range of about 10 ppm to about 500 ppm of active materials, or in the range of about 10 to about 300 ppm, or in the range of about 10 to 200 ppm.

The use solution can be applied to the substrate during a presoak application, for example, in a warewashing machine, a car wash application, institutional healthcare surface cleaning or the like. In some embodiments, formation of a use solution can occur from a presoak agent installed in a cleaning machine, for example onto a dish rack. The presoak agent can be diluted and dispensed from a dispenser mounted on or in the machine or from a separate dispenser that is mounted separately but cooperatively with the dish machine.

In other example embodiments, solid products may be conveniently dispensed by inserting a solid material in a container or with no enclosure into a spray-type dispenser such as the volume SOL-ET controlled ECOTEMP Injection Cylinder system manufactured by Ecolab Inc., St. Paul, Minn. Such a dispenser cooperates with a washing machine. When demanded by the machine, the dispenser directs water onto the solid block of agent which effectively dissolves a portion of the block creating a concentrated aqueous presoak solution which is then fed directly into the water forming the aqueous pre-soak. The aqueous pre-soak is then contacted with the surfaces to affect a soaking composition. This dispenser and other similar dispensers are capable of controlling the effective concentration of the active portion in the aqueous composition by measuring the volume of material dispensed, the actual concentration of the material in the water (an electrolyte measured with an electrode) or by measuring the time of the spray on the solid block.

The above description provides a basis for understanding the broad meets and bounds of the invention. The following examples and test data provide an understanding of certain specific embodiments of the invention. These examples are not meant to limit the scope of the invention. Unless otherwise noted, all parts, percentages, and ratios reported in the following examples are on a weight basis, and all reagents used in the examples were obtained, or are available, from the chemical suppliers described below, or may be synthesized by conventional techniques.

EXAMPLES

Dimensional Stability Test for Formed Products

A liquid premix was formed by mixing water and a polymer together. A powder premix was formed by mixing soda ash together in a separate container. The liquid premix was gradually added to the powder premix while stirring to achieve a homogeneous product. Immediately after mixing, approximately 50 gram of the product was pressed in a die at approximately 1000 pounds per square inch (psi) for approximately 20 seconds to form tablets. After storage for one hour at room temperature, the diameter and height of each tablet was measured and recorded.

Five tablets were formed and placed in an oven at 122° F. The diameter and height of each tablet was measured and recorded after four weeks of storage in the oven. The diameters and heights were measured by digital calipers. The tablets were considered to exhibit dimensional stability if there was a combined diameter and height swelling or growth of less than approximately 3%, and particularly less than approximately 2%.

| SAMPLE BIO-BASED FORMULATION | |
|---|---|
| Bio based nonionic surfactant | 3-10 |
| Water | 1-5 |
| threshold agent/builder | 5-10 |
| alkalinity source | .1-10 |
| threshold agent | .1-10 |

-continued

| | |
|---|---|
| polysaccharide polymer | 1-10 |
| Dye/fragrance | 0-1 |
| alkalinity source | 50-90 |
| metal protector | 10-30 |
| TRADITIONAL NON-BIO-BASED FORMULA | |
| nonionic surfactant | 3-10 |
| Water | 1-20 |
| threshold agent/builder | 1-5 |
| pH adjuster(50%) | .1-10 |
| threshold agent | .1-15 |
| Fragrance/dye | 0-1 |
| alkalinity source | 40-90 |
| metal protector | 10-30 |

Initial Dimensions

| Bio-Based No Color No Fragrance (mm) | Bio-Based With Color With Fragrance (mm) | Traditional With Color With Fragrance (mm) |
|---|---|---|
| 1) 21.27 × 44.70 | 1) 21.15 × 44.73 | 1) 19.15 × 44.91 |
| 2) 21.13 × 44.65 | 2) 21.15 × 44.76 | 2) 19.24 × 44.84 |
| 3) 21.42 × 44.64 | 3) 21.42 × 44.75 | 3) 19.21 × 44.88 |
| 4) 21.23 × 44.68 | 4) 21.20 × 44.65 | 4) 19.34 × 44.78 |
| 5) 21.24 × 44.61 | 5) 21.24 × 44.67 | 5) 19.18 × 44.82 |

Final Dimensions After 4 Weeks @ 120° F.

| Bio-Based No Color No Fragrance (mm) | Bio-Based With Color With Fragrance (mm) | Traditional With Color With Fragrance (mm) |
|---|---|---|
| 1) 21.37 × 44.59 | 1) 21.04 × 44.62 | 1) 19.09 × 45.11 |
| 2) 21.34 × 44.59 | 2) 21.08 × 44.58 | 2) 19.16 × 45.08 |
| 3) 21.45 × 44.61 | 3) 21.17 × 44.56 | 3) 19.21 × 45.07 |
| 4) 21.24 × 44.64 | 4) 21.26 × 44.64 | 4) 19.11 × 45.09 |
| 5) 21.37 × 44.61 | 5) 21.17 × 44.58 | 5) 19.34 × 44.94 |

What is claimed is:

1. A detergent composition comprising (a) about 30 wt. % to about 80 wt. % alkalinity source;

(b) about 15 wt. % to about 35 wt. % metal protector;

(c) about 2 wt. % to about 10 wt. % lauryl alcohol ethoxylate, (d) about 0.1 wt. % to about 70 wt. % water;

(e) about 0.2 wt. % to about 15 wt. % threshold agent; and (f) about 0.05 wt. % to about 20 wt. % of a polysaccharide hybrid polymer component, wherein the dimensionally stable solid detergent composition has a bio-based content of at least 58% or greater.

2. The detergent composition of claim 1, wherein the polysaccharide hybrid polymer includes a polysaccharide residue present in an amount from approximately 5% to 90% by weight of the polysaccharide hybrid polymer composition and a residue of at least one ethylenically unsaturated monomer or salts thereof present in an amount from approximately 10% to 75% by weight of the polysaccharide hybrid polymer composition.

3. The detergent composition of claim 1, further comprising a scale inhibitor.

4. The detergent composition of claim 1 wherein said detergent composition may be diluted to form a use solution.

5. The detergent composition of claim 1, wherein the detergent composition is a concentrated liquid.

6. The detergent composition of claim 1 wherein said composition includes from about 0.05 wt. % and about 20 wt. % of said polysaccharide hybrid polymer composition.

7. The detergent composition of claim 6 wherein said polysaccharide hybrid polymer composition comprises from about 1 wt. % to about 10 wt. % of said composition.

8. The detergent composition of claim 3 wherein said scale inhibitor is present in an amount of from about 1 wt. % to about 15 wt. %.

9. A dimensionally stable solid detergent composition comprising (a) an alkalinity source;

(b) a metal protector;

(c) a nonionic low foaming surfactant of lauryl alcohol ethoxylate;

(d) water;

(e) a scale inhibitor;

(f) a threshold agent; and (g) a polysaccharide hybrid polymer composition, wherein the composition has a bio-based content of at least 58% or greater.

10. The detergent composition of claim 9 wherein said alkalinity source is a metal carboxylate.

11. The detergent composition of claim 9 wherein said metal protector is sodium silicate.

12. The detergent composition of claim 9 wherein said scale inhibitor is a citrate.

13. A method of making a dimensionally stable pressed solid soaking composition comprising:

admixing an alkalinity source; a metal protector; a nonionic low foaming surfactant of lauryl alcohol ethoxylate; water; a threshold agent; and polysaccharide hybrid polymer of at least two ethylenically unsaturated monomers to form a mixture and pressing said mixture into a pressed solid composition.

14. The method of claim 13 wherein said mixture is pressed in a die at approximately 1000 pounds per square inch (psi) for approximately 20 seconds to form tablets.

15. The method of claim 13 wherein said solid is dimensionally stable after 4 weeks at 120 degrees F.

16. The method of claim 13 wherein said polysaccharide hybrid polymer includes a polysaccharide residue present in an amount from approximately 5% to 90% by weight of the polysaccharide hybrid polymer composition and a residue of at least one ethylenically unsaturated monomer or salts thereof present in an amount from approximately 10% to 75% by weight of the polysaccharide hybrid polymer composition.

17. The method of claim 13 wherein said solid has a bio-based content of at least 58% or greater.

18. The method of claim 13 wherein said pressed solid is mixed with water to form a use composition.

* * * * *